US005277561A

United States Patent [19]

Dresler et al.

[11] Patent Number: 5,277,561

[45] Date of Patent: Jan. 11, 1994

[54] VERY LOW TEMPERATURE PISTON PUMP

[75] Inventors: Helmut Dresler, Trostberg; Ernest Turnwald, Altenmarkt, both of Fed. Rep. of Germany

[73] Assignee: Linde Aktiengesellschaft, Wiesbaden, Fed. Rep. of Germany

[21] Appl. No.: 995,296

[22] Filed: Dec. 21, 1992

[30] Foreign Application Priority Data

Dec. 19, 1991 [DE] Fed. Rep. of Germany ..... 4142053

[51] Int. Cl.[5] ..... F04B 15/08

[52] U.S. Cl. ..... 417/401; 417/901; 62/50.7

[58] Field of Search ..... 417/901, 254, 398, 399, 417/400, 401, 456, 552, 569; 62/50.7

[56] References Cited

U.S. PATENT DOCUMENTS

| | | | |
|---|---|---|---|
| 3,910,729 | 10/1975 | Jepsen et al. | 92/66 |
| 4,146,355 | 3/1979 | Bröker et al. | 417/457 |
| 4,239,460 | 12/1980 | Gölz | 417/901 |
| 4,388,051 | 6/1983 | Dresler et al. | 417/505 |
| 5,146,124 | 9/1992 | Higham et al. | 417/901 |

*Primary Examiner*—Richard A. Bertsch
*Assistant Examiner*—Alfred Basichas

[57] ABSTRACT

A piston pump for conveying cryogenic fluids, especially liquid hydrogen, permits reliable transport of relatively large amounts of the fluid at high conveying pressures even with horizontal operation of the pump. The actual pump is inserted in an inner casing pipe (3, 25) of a vacuum housing. The pump is connected by a thread at one end of the housing and sealed against the atmosphere by an O-ring. The cylinder of the piston pump is sealed with respect to the inner casing pipe on the high-pressure side as well as on the low-pressure side by means of synthetic resin gaskets.

12 Claims, 3 Drawing Sheets

VERY LOW TEMPERATURE PISTON PUMP

BACKGROUND OF THE INVENTION

The invention relates to a piston pump for conveying a fluid in the very low temperature range, with a pump casing comprising an inner casing pipe and fashioned as a vacuum housing, a cylinder being arranged in the inner casing pipe, a piston being displaceable in the longitudinal direction in this cylinder, one end of the cylinder being associated with a high-pressure side and the other end of the cylinder being associated with a low-pressure side of the piston pump, and a piston rod guide means adjoining the cylinder on the low-pressure side wherein a piston rod, connected at one end with the piston and at the other end with a drive mechanism located outside the pump casing, is displaceable in the longitudinal direction.

Conventional low-temperature pumps are used for pumping liquid nitrogen, oxygen, argon, carbon dioxide and hydrocarbon. Since, in these areas of application, the lowest usage temperature is at about −200° C., and the heat of evaporation is relatively great, the conventional pumps need not meet any stringent requirements with respect to insulation and sealing. Additionally, these liquefied gases are produced in a relatively economical way.

However, the low-temperature pumps of the state of the art are not suited for pumping liquid hydrogen, on account of the high refrigeration losses occurring therein. Hydrogen exhibits merely 1/6 of the heat of evaporation of nitrogen; the temperature of liquid hydrogen is at −2530° C., and its viscosity is very low. Besides, production of liquid hydrogen is costly. For these reasons, special requirements must be met by lowest-temperature pumps which are to be suitable for conveying fluids in the lowest-temperature range of below −250° C., especially for pumping liquid hydrogen.

Although there are sporadic suggestions of pumps said to be suitable for conveying liquid hydrogen (see German Patent 3,621,727 and European Patent 0,069,324), these are so-called immersion pumps, installed from above in a vessel filled with liquid hydrogen. This arrangement may be suited for laboratory pumps of low pressures, as well as for relatively small conveying quantities. However, since only small-sized, lightweight drive mechanisms can be flanged to these pumps, the latter are not suitable for producing high-pressure hydrogen in larger conveying quantities, on account of the high driving forces and thus gearing masses required therefor. Besides, when engaged in high-pressure compression of hydrogen, the pumps must meet very much higher demands than when conveying small amounts at low pressures. This is due to the difficult physical properties, such as heat of evaporation, temperature, and viscosity of the liquid hydrogen.

SUMMARY OF THE INVENTION

The present invention is based on the object of providing a piston pump suitable even for conveying relatively large amounts of extremely cold fluids with temperatures of below −250° C. at high conveying pressures.

This object has been attained according to this invention by providing that the cylinder and the piston rod guide means are inserted in the inner casing pipe, the piston rod guide means is attached to the pump casing on the end facing away from the cylinder and is sealed with respect to the atmosphere by means of an O ring, and the cylinder is sealed on the high-pressure side as well as on the low-pressure side with respect to the inner casing pipe by means of synthetic resin gaskets, wherein the synthetic resin gasket on the low-pressure side is urged, in the transitional zone from the cylinder to the piston rod, against the inner casing pipe by a clamping element of a material having a lower thermal contraction than the material of the pump casing.

Preferably, the synthetic resin seal on the low-pressure side is fashioned as a V-lip gasket wherein one lip (outer lip) is pressed against the inner casing pipe by the clamping element attached to the end of the cylinder on the low-pressure side, whereas the other lip (inner lip) is in contact with the piston rod guide means adjoining the cylinder.

In order to install the V-lip gasket, the latter is pressed, with the pump being dismounted, into a mounting sleeve, and the outer lip is pretensioned over the cylinder by means of the clamping element. Upon insertion of the pump in the casing, the mounting sleeve is compressed by the outer sealing lip whereby a reliable seal is established between the pump and the casing. Since the clamping element is made of a material (e.g. titanium) having a contraction lower than the casing material (e.g. chrome-nickel), the gasket experiences still an additional pretensioning during cooling. An absolute fluid tightness is achieved with this device even at high conveying pressures so that it makes no difference with respect to statistical heat conduction whether the piston pump is operated as an immersion pump (vertically with complicated drive mechanism) or horizontally.

The invention provides a high-pressure piston pump for the pumping of cryogenic fluids for conveying pressures up to 1000 bar, with a high conveying power and a very good delivery rate. The pump, in contrast to the customary hydrogen pumps, can be flanged in the horizontal position to a conventional reciprocating drive unit and can be connected and operated with only one feed line, for example to each liquid hydrogen tank.

In order to keep the thermal conduction and thus also the static evaporation at a low value, the inner casing pipe preferably has a small cross section. Besides, the piston rod is advantageously equipped with a plastic insulator. Furthermore, at least a portion of the piston rod guide means is preferably made of a synthetic resin. This involves, in particular, the so-called packing housing, i.e. the part of the piston rod guide means establishing the pump connection from the cold part to the hot part of the pump. Moreover, at least a portion of the interspace between the piston rod guide means and the inner casing pipe is filled with a glass fabric. Wrapping the packing housing pipe with a glass fabric prevents heat transport as a consequence of convection in the interspace between pump and casing. For the insulation of the entire pump casing with integrated gas separator, a mutiple-layer superinsulation with high vacuum is utilized.

On account of the low heat of evaporation of liquid hydrogen, the high-pressure pump is built in a two-stage design, the cylinder being equipped with a smaller high-pressure bore and a larger low-pressure bore.

The piston rod is studded, in the region of the high-pressure bore, preferably with special high-density piston rings causing very low friction. These are twin piston rings of PTFE (polytetrafluoroethylene or TEFLON®) composed of a rectangular collar and an angular collar, each of which has a gap, a locking lug being mounted to the angular collar engaging int(D the gap of the rectangular collar. Bipartite twin piston rings consisting of an angular collar and a rectangular collar are known per se. The designations "angular collar" and, respectively, "rectangular collar" refer to the sectional surfaces of the rings. The two rings have a gap whereby assembly is made possible by bending. Any twisting of the collars with respect to each other is conventionally prevented by a locking pin. In order to improve the comparatively complicated assembly, above all in case of small collar diameters, a locking lug fixedly mounted to the angular collar is preferred, in place of a locking pin, in the piston pump according to this invention, this locking lug precisely engaging the gap of the rectangular collar. In this arrangement, the diameter of the angular collar is enlarged in the environment of the lug to obtain a secure seal even in the lug and gap zone of the two collars. Since the rectangular collar is preferably installed on the side facing away from the pressure side, this collar takes over the main amount of work so that the angular collar has the nominal diameter of the rectangular collar only in the zone of the locking lug (with overlapping). On account of this measure, as well as by the selection of a suitable PTFE modification, friction is minimized. By means of these special piston rings, excellent tightness and about 40% less friction are obtained than in case of the conventional twin piston rings.

Three webs are disposed on the piston rod in the zone of the low-pressure bore of the cylinder, and also a rectangular extension is provided on the high-pressure side contacted by a charging pressure limiting means. In the annular chamber disposed therebetween, a high-sealing piston ring is preferably likewise retained in a flow member and guided in a charging bushing.

According to a preferred embodiment of the invention, the pump has a gas separator with an integrated optoelectronic sensor which latter distinguishes liquid from gas. The sensor, via a switching amplifier, operates a solenoid valve removing gas obtained during cooling as well as during operation. Therefore, there is no need to provide a communicating vacuum return line to the storage tank.

Since the complete pump is inserted in the vacuum housing and there exists only one junction site from the pump to the housing which, moreover, is in a hot environment, an excellent insulation of the lowest-temperature piston pump is achieved. The thermal conduction is held to a minimum also by the installation of synthetic resin in a portion of the piston rod and in the packing housing, as well as by wrapping glass fabric around the packing housing pipe. Besides, the extremely low-friction piston rings also contribute toward an extremely low heat generation. Last, but not least, the plastic gaskets in the high-pressure and low-pressure zones of the pump take care of an absolute fluid tightness whereby likewise low refrigerating losses are achieved.

The thus-presented pump concept can be adapted as needed to the required delivery quantities and conveying pressures. It can be applied to process and filling pumps.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
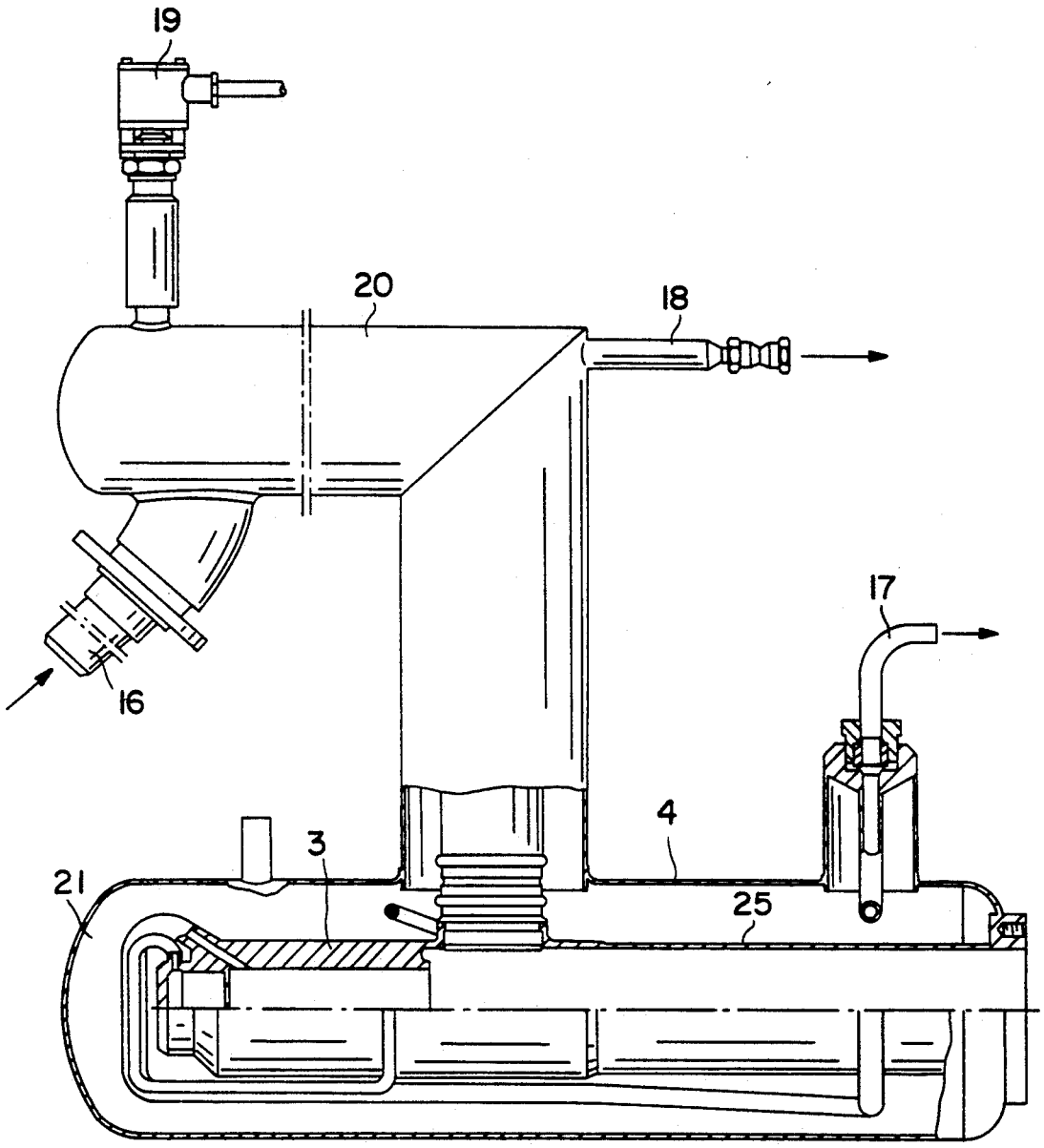
FIG. 1 is a total view of the very low temperature pump with pump casing, suction conduit and high-pressure conduit.
Figure 2:
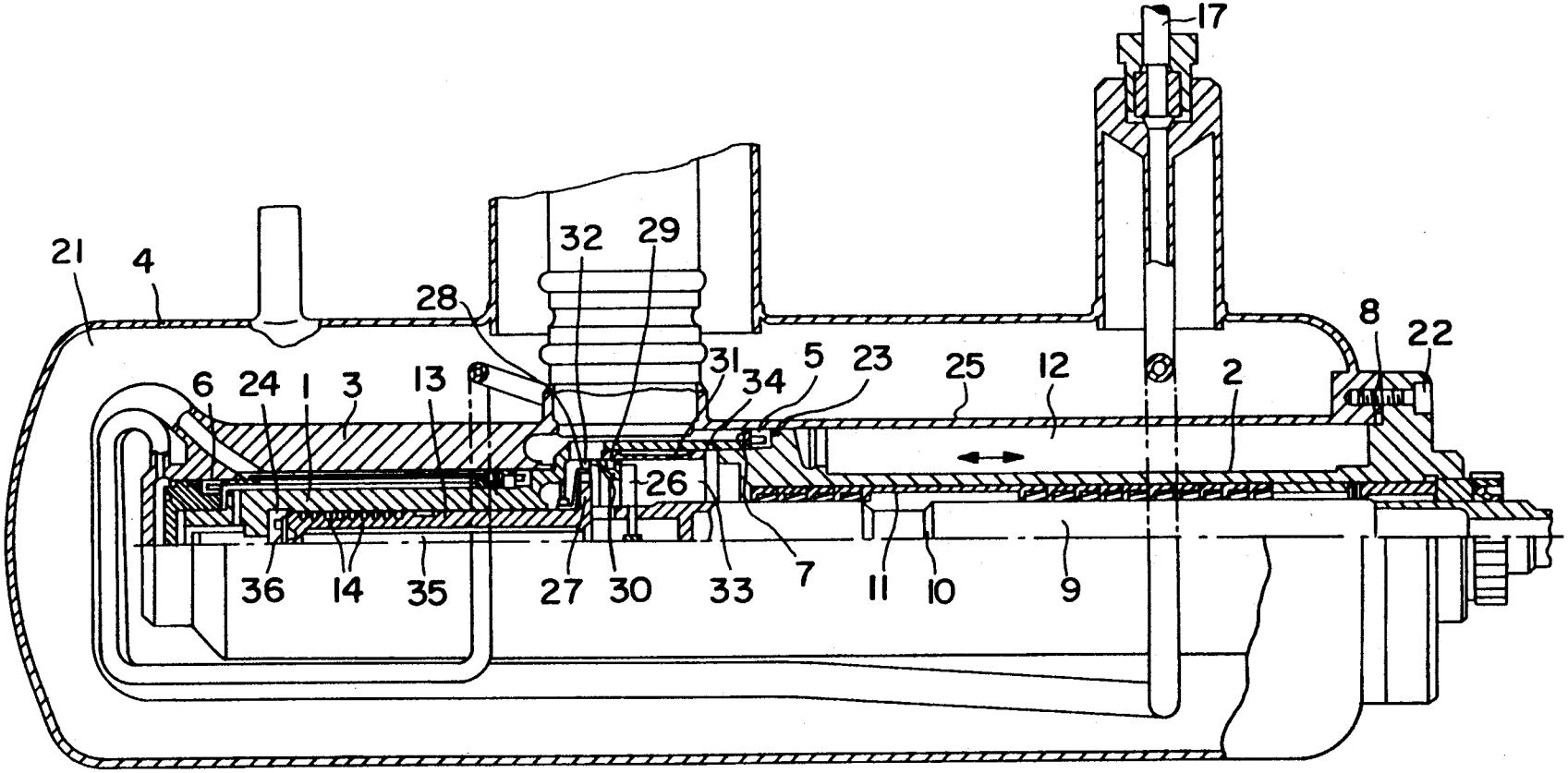
FIG. 2 shows a detailed view of the very low temperature pump in a longitudinal sectional view.

In FIG. 1, the entire pump arrangement is illustrated with the pump casing 4 and a suction conduit 16 connected thereto for the extremely cold fluid to be pumped, a high-pressure conduit 17 for the compressed fluid, an exhaust gas conduit 18 and a gas separator 20 with gas sensor 19. A longitudinal section through the upper half of the pump casing 4 shows merely the inner casing pipe 3, 25 in which the actual pump has not as yet been inserted (the details of the actual pump inserted in the inner casing pipe 3, 25 are illustrated in FIG. 2 on an enlarged scale). The connection of the vacuum conduit 16, coming from the storage tank, not shown, with the pump takes place via a coupling, the inner part of which is in communication with the high-vacuum chamber 21 of the pump casing 4. By opening an electromagnetic valve, not shown, in the exhaust gas conduit 18 (by operating a manual on-switch), cryogenic fluid flows into the pump and cools the latter. After the pump has been cooled off, which manifests itself by rhythmic operation of the solenoid valve is caused by the sensor 19 installed in the horizontal gas separator 20; this sensor can distinguish a liquid from a gas and, in case of a liquid, transmits a signal to a switching amplifier which latter closes the solenoid valve and reopens it when gas is present.

Figure 3:
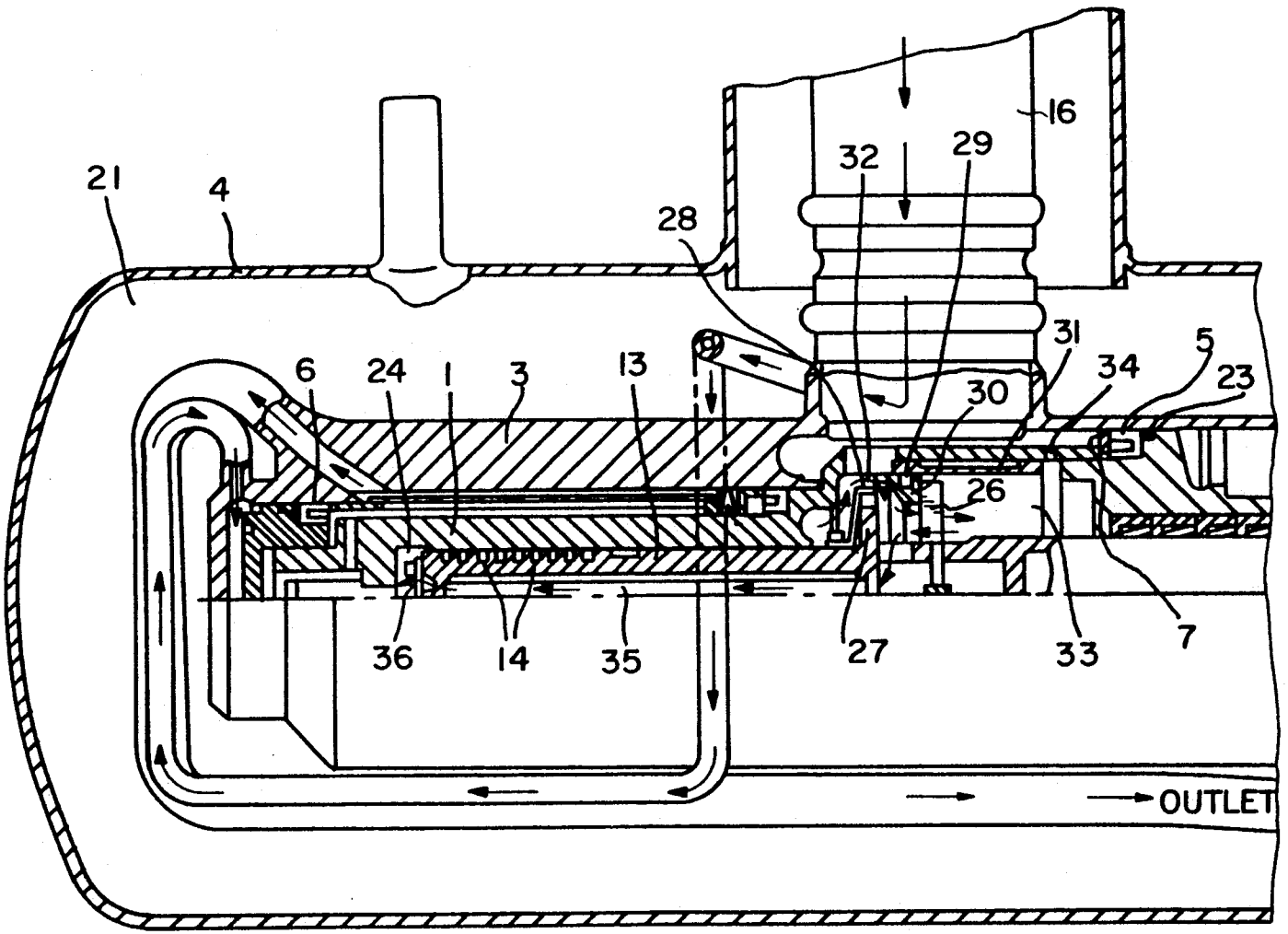
FIG. 3 is an enlarged view of a portion of FIG. 2.

FIGS. 2 and 3 illustrate the pump casing 4 with the inserted pump in detail. For an easier understanding, the individual apparatus parts will be described simultaneously with their function.

The actual pump, consisting essentially of the cylinder 1, the piston rod guide means 2, the piston 13, and the piston rod 9, inserted in the inner casing pipe 3, 25, is connected to the pump casing 4 by means of screws 22 and sealed against the atmosphere by means of the O ring 8. The V-lip seal 5 makes horizontal operation of the pump possible. This seal is urged into the mounting sleeve 23 with the pump being dismounted, and the outer lip of the lip gasket 5 is pretensioned with the clamping element 7 over the cylinder 1. During insertion of the pump in the casing, the mounting sleeve 23 is subjected to pressure from the outer sealing lip whereby a reliable seal is established between pump and casing 4. Since the clamping element 7 consists of a material of lower contraction (e.g. titanium) than the casing material (e.g. chrome-nickel), the gasket 5 experiences also an additional pretensioning during cooling. In this way, an absolute fluid tightness is achieved even at high conveying pressures. In order to keep thermal conduction and thus also static evaporation at a minimum, the inner casing pipe 25 has a small cross section. The piston rod 9 is provided with a plastic insulator 10 for reducing the thermal conduction via the piston rod 9. Besides, the packing housing 11, i.e. the pump connection, is produced in cold-hot fashion from a synthetic resin. The interspace between the piston rod guide means 2 and the inner casing pipe 25 is filled with a glass cloth in order to minimize heat transport as a consequence of convection in the interspace 12 of pump-casing.

The high-pressure pump is build in a two-stage design on account of the low heat of evaporation of liquid hydrogen. The cylinder 1 is designed with a smaller high-pressure bore 24 and a larger low-pressure bore 33. The piston 13 is equipped in the region of the high-pressure bore 24 with special highly tight piston rings 14 causing very low friction. In the zone of the low-pressure bore 33, three webs 26 are arranged, and on the high-pressure side a rectangular extension 27 is located contacted by a charging pressure limiting device 28. In the interposed annular space, a likewise high-sealing piston ring 29 is retained in a flow member 30 and guided in a charging bushing 31. When moving the piston rod 9 from the rearward dead-center position in the direction toward a pressure stroke, the flow member 30 cones into contact with the webs 26, a gap 32 being formed between the charging pressure limiter 28 and the baffle 30. When moving the piston rod 9 further in the direction toward a pressure stroke, the piston ring 29 pulls the charging bushing 31 up to abutment (forcible control). During this step, low-pressure fluid flows without resistance into the low-pressure chamber 33, without having to open a spring-loaded valve, which represents a special advantage. By the drawing up of the charging bushing 31, the low-pressure chamber 33 exhausts gas via bores 34 in the cylinder 1. Upon stroke reversal, the gap 32 and, by entrainment of the charging bushing 31 by the piston ring 29, also the bores 34 are sealed off. Since the volume of the low-pressure chamber 33 represents a multiple of the high-pressure chamber 24, the low-pressure fluid is subjected to a pressure increase. This rise in pressure reliably prevents evaporation of the conveying fluid, which latter is mostly in the boiling condition, and ensures in this way an optimum gas-free filling of the high-pressure chamber 24. The size of the pressure increase is obtained by the pretensioning of the charging pressure limiting means 28 designed as a cup spring. Once the charging pressure has been reached, the charging pressure limiter 28 is urged by the flow member 30, as well as by the pressure on its surface, off the edge of the rectangular extension 27 of the piston 13, whereby excess pressure is removed through bores in the charging pressure limiter into the low-pressure fluid.

An alternative embodiment for the actual pump structure is set forth in a copending U.S. patent application, entitled PISTON PUMP, filed Nov. 23, 1992, in the name of Helmut Dresler and Ernst Turnwald, the disclosure of which incorporated herein by reference.

The entire disclosures of all applications, patents and publications, cited above and below, and of corresponding German Application P 41 42 053.5, filed Dec. 19, 1991, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A piston pump for conveying a fluid in a very low temperature range in combination with a pump casing having a material of a first thermal contraction comprising an inner casing pipe and fashioned as a vacuum housing, a cylinder located in the inner casing pipe, a piston displaceable in a longitudinal direction in the cylinder, the cylinder having a first end associated with a high-pressure side of the piston pump and a second end associated with a low-pressure side of the piston pump; a piston rod guide means adjoining the cylinder on the low-pressure side; a piston rod connected at one end with the piston and at the other end with a drive mechanism located outside the pump casing being displaceable in the longitudinal direction, the improvement comprising:

the cylinder (1) and the piston rod guide means (2) being inserted in the inner casing pipe (3, 25), the piston rod guide means (2) being attached to the pump casing (4) at the second end (22) facing away from the cylinder (1) and being sealed with an O-ring (8) against the atmosphere; the cylinder (1) being sealed with respect to the inner casing pipe (3) on the high-pressure side as well as on the low-pressure side by synthetic resin gaskets (5, 6), wherein the synthetic resin gasket (5) on the low-pressure side is urged against the inner casing pipe (3) in a transitional zone from the cylinder (1) to the piston rod (2) by means of a clamping element (7) being made of a material having a lower thermal contraction than the material of the pump casing.

2. The piston pump according to claim 1, wherein the synthetic resin gasket (5) on the low-pressure side is a V-lip seal having an outer lip pressed against the inner casing pipe (3) by the clamping element (7) mounted on the end of the cylinder (1) on the low-pressure side, and an inner lip in contact with the piston rod guide means (2) adjoining the cylinder (1).

3. The piston pump according to claim 2, wherein the piston rod (9) is equipped with a synthetic resin insulator (10).

4. The piston pump according to claim 3, wherein at least a portion (11) of the piston rod guide means (2) is made of a synthetic resin.

5. The piston pump of claim 4, wherein a portion of an interspace (12) between the piston rod guide means (2) and the inner casing pipe (25) is filled with a glass fabric.

6. The piston pump according to claim 5, wherein the piston rod (9) is surrounded by a piston jacket (13) with twin piston rings (14) made of polytetrafluoroethylene disposed therebetween, the piston pump being further comprised of a rectangular collar (27) and an angular collar (30) arranged with the angular collar (27) extending into the gap of the rectangular collar.

7. The piston pump according to claim 6, wherein the high-pressure side is associated with a high-pressure chamber (24) and the low-pressure side is associated with a low-pressure chamber (33) with a volume that is larger as compared with the high-pressure chamber (24).

8. The piston pump according to claim 1, wherein the piston rod (9) is equipped with a synthetic resin insulator (10).

9. The piston pump according to claim 1, wherein at least a portion (11) of the piston rod guide means (2) is made of a synthetic resin.

10. The piston pump of claim 1, wherein a portion of an interspace (12) between the piston rod guide means (2) and the inner casing pipe (25) is filled with a glass fabric.

11. The piston pump according to claim 1, wherein the piston rod (9) is surrounded by a piston jacket (13) with twin piston rings (14) made of polytetrafluoroethylene disposed therebetween, the piston pump being further comprised of a rectangular collar (27) and an angular collar (30) arranged with the angular collar (27) extending into the gap of the rectangular collar.

12. The piston pump according to claim 1, wherein the high-pressure side is associated with a high-pressure chamber (24) and the low-pressure side is associated with a low-pressure chamber (33) with a volume that is larger as compared with the high-pressure chamber (24).

* * * * *